United States Patent [19]

Lach et al.

[11] 4,272,243

[45] Jun. 9, 1981

[54] DYEING OF GRAIN LEATHER

[75] Inventors: Dietrich Lach, Friedelsheim; Rolf Streicher, Worms; Franz Feichtmayr, Ludwigshafen, all of Fed. Rep. of Germany

[73] Assignee: BASF Aktiengesellschaft, Fed. Rep. of Germany

[21] Appl. No.: 102,847

[22] Filed: Dec. 12, 1979

[30] Foreign Application Priority Data

Dec. 29, 1978 [DE] Fed. Rep. of Germany ..... 2856628

[51] Int. Cl.[3] ..... D06P 5/00; D06P 5/02

[52] U.S. Cl. ..... 8/436; 8/437

[58] Field of Search ..... 8/12, 12.5, 436, 437

[56] References Cited

U.S. PATENT DOCUMENTS

| | | | |
|---|---|---|---|
| 2,228,369 | 1/1941 | Schoeller | 8/524 |
| 2,763,528 | 9/1956 | Meyer et al. | 8/12 |
| 2,872,277 | 2/1959 | Kirk | 8/12 |
| 2,893,811 | 7/1959 | Kirk | 8/12 |
| 3,334,960 | 8/1967 | Abel | 8/54 |
| 3,972,675 | 8/1976 | Schwank | 8/404 |

FOREIGN PATENT DOCUMENTS

| | | |
|---|---|---|
| 705335 | 3/1954 | United Kingdom . |
| 769174 | 2/1957 | United Kingdom . |

*Primary Examiner*—Joseph L. Schofer
*Assistant Examiner*—Maria Parrish Tungol
*Attorney, Agent, or Firm*—Keil & Witherspoon

[57] ABSTRACT

A process for dyeing grain leather with anionic dyes under the conventional conditions for exhaustion methods, in the presence of two specific surfactants. The combined use of the two surfactants results, in the case of cationically tanned (essentially mineral-tanned) leather, in an improvement in the levelness and dye penetration and in the case of anionically tanned (synthetics-tanned or vegetable-tanned) or retanned leather, in an increase in depth of the color.

The two surfactants are (a) an aliphatic alcohol of 9 to 24 carbon atoms oxyethylated with from 3 to 120 ethylene oxide units and (b) an aliphatic amine of 8 to 20 carbon atoms oxyethylated with from 6 to 80 ethylene oxide units, and they are used in a weight ratio of a:b of from 1:4 to 4:1 and in a total amount of from 0.3 to 3%, based on shaved weight.

3 Claims, No Drawings

DYEING OF GRAIN LEATHER

The general problem in dyeing leather with the conventional anionic dyes is as follows:

In the case of exclusively or predominantly cationically tanned leather, difficulties in respect of levelness, and depth of penetration of the dye from the grain side, have to be overcome. In general, a great variety of leveling agents and surfactants are employed to improve these aspects. In the case of anionically tanned or retanned leather, the problem is the achievable depth of color, since the cationic centers of the leather are already occupied by anionic tanning agents and hence there is no longer any great affinity for the dye, which is also anionic. Here, the use of cationic assistants provides help. However, a dyeing assistant or dyeing process which provides a very good solution for both problems simultaneously has not been disclosed.

Dyeing of leather with acid dyes in the presence of a variety of surfactants is disclosed, for example, in British Pat. No. 769,174. According to German Pat. application No. B 15,087 IVd/8m, published on 13.11.1952, suitable surfactants for this purpose include oxyethylated alcohols or amines, amongst many others. Nowhere is there reference to the use of a mixture of both (i.e. oxyethylated alcohols and oxyethylated amines).

According to German Pat. No. 667,744, British Pat. No. 705,335 and U.S. Pat. No. 2,893,811, oxyethylated amines are employed, inter alia, as leather dyeing assistants. Unless special measures, for example intensive drumming in a short liquor, are taken, the depth of penetration of the dye from the grain side, achieved in this process, is only slight. Accordingly, subsequent scratches on leather dyed in this way are visible and this is objectionable.

According to U.S. Pat. No. 3,334,960, combinations of oxyethylated amines and oxyethylated alcohols can, amongst many other possible materials, be employed as assistants for pad-dyeing nitrogen-containing fibrous materials. An example of the use of this combination is not given. The dyebath must contain from 4 to 30% of carboxylic acids and the dyed material must be stored moist for from 10 minutes to 24 hours after impregnation. Accordingly, the process requires a plurality of steps, and is therefore labor-intensive and time-consuming.

It is an object of the present invention to provide a simple dyeing process, and a dyeing assistant for grain leather, which overcomes all the above problems simultaneously, i.e. which in the case of entirely or predominantly cationically tanned grain leather gives very level dyeings and good dye penetration and in the case of anionically tanned or retanned leather gives deep shades simultaneously with levelness and dye penetration.

We have found that this object is achieved by a process as claimed in claim 1 and its specific embodiments as claimed in claims 2 or 3 and by the use of an aqueous surfactant solution.

According to the invention, using one and the same surfactant solution it is possible to obtain level dyeings, with deep penetration even from the grain side, in any leather dyeing operation using anionic dyes, regardless of how the leather has been tanned; more specifically, deep shades can also be achieved. Hitherto, different assistants had to be employed for these purposes, depending on the nature of the leather.

In the case of cationically tanned leather, the surfactant mixture preferably is employed up to 30 minutes before the dye or simultaneously therewith. Its simultaneous addition is preferred. In the case of anionically tanned or retanned leather, the dye is advantageously employed from 5 to 90, preferably from 15 to 30, minutes, the surfactant mixture is added.

Grain leather possesses the natural grain which is known to be more difficult to surface-dye, or dye in depth, than the flesh side, and than corrected grain leather.

For the purpose of the present invention, "dyeing of leather" is to be interpreted in the narrower sense, i.e. dyeing with dyes which are absorbed on the leather fibers, and does not include pigment finishing of leather, and lacquering of leather.

Anionic dyes are those with one or more acid radicals, in most cases sulfonic acid radicals. According to Ullmann, Enzyklopädie der Technischen Chemie, volume 11, page 573, they include the following categories of dyes, which are described in more detail on pages 574 and 575 of the same volume and in particular on the pages in volume 4 referred to in volume 11: acid dyes, direct dyes, developed dyes, mordant dyes and metal complex dyes. Because of their good fastness characteristics, these categories are also the most commonly used dyes for leather.

Cationically tanned leather is essentially leather which has been tanned with mineral tanning agents. The latter are, in particular, salts of trivalent chromium, but also of aluminum and of tetravalent zirconium. It is true that other salts, for example those of iron, titanium, cerium and tin, can in principle be used, but in practice they are, for technical or economic reasons, of no significance. The mineral tanning agents are described in more detail in Ullmann, volume 11, pages 604–608. There are also cationic synthetic tanning agents, described in loc. cit., page 598, and cationic resin tanning agents based on dicyandiamide, described in loc. cit., page 602. However, they are of minor importance compared to mineral tanning agents, especially chrome tanning agents. Accordingly, the terms "cationic" tanning agent and "mineral" tanning agent can, for practical purposes, be regarded as substantially synonymous.

Anionically tanned or retanned leather is leather which has been tanned or retanned with vegetable tanning agents or with anionic synthetic tanning agents and contains more than 6%, based on the dry hide weight, of vegetable and/or anionic synthetic tanning agents.

Vegetable tanning agents are the oldest tanning agents of all and therefore do not really require definition here. Amongst the most important are extracts of the bark of various species of trees (above all oak, pine, mimosa and mangrove) but also of heartwood (quebracho, chestnut and oak) as well as of leaves and/or leaf stems (sumach or gambir) or of fruit (algarobilla, bablah, divi-divi, myrobalane or valonea). They are described in more detail in Ullmann, volume 11, pages 585–595.

The anionic synthetic tanning agents essentially comprise the syntans, i.e. condensates of phenolic and/or sulfonated aromatics with formaldehyde; the sulfonation of such compounds may be carried out before or after the condensation. These condensates are described in Ullmann, volume 11, pages 595–600. The category also includes the ligninsulfonates described on page 777 loc. cit. They have in common a more or less pronounced anionic character, which they impart to the leather when used for tanning or retanning (provided the amount of tanning agent employed for retanning suffices, i.e. amounts to more than 6 percent by weight, based on dry weight).

Examples of the aliphatic alcohols of 9 to 24, preferably of 10 to 18, carbon atoms, oxyethylated with from 3 to 120, preferably from 60 to 100, ethylene oxide units, which can be used, according to the invention, as surfactants of group a are the relevant oxyethylation products of natural tallow alcohol, synthetic tallow alcohol, $C_9/C_{11}$-oxo-alcohol and $C_{13}C_{15}$-oxo-alcohol.

Examples of aliphatic primary or secondary amines of 8 to 20, preferably of 12 to 18, carbon atoms per alkyl group, oxyethylated with from 6 to 80, preferably from 9 to 30, ethylene oxide units, which can be used, according to the invention, as surfactants of group b are the relevant oxyethylation products of octylamine, nonylamine, tridecylamine, oleylamine, stearylamine, 2-ethylhexylamine and di-tridecylamine.

The dyeing conditions employed are those conventionally used for exhaustion methods, i.e. dyeing is carried out in a drum or dyeing apparatus for from 30 to 180, preferably from 60 to 120, minutes at from 5° to 60° C., preferably from 20° to 50° C., with a liquor length of from 50 to 500%, preferably from 100 to 200%, and a total amount of surfactant (a+b) of from 0.3 to 3%, preferably from 0.5 to 2%, based on the shaved weight. The weight ratio of oxyethylated alcohol (component a) to oxyethylated amine (component b) is from 1:4 to 4:1, preferably from 1:2 to 2:1.

The surfactant mixture according to the invention is advantageously marketed in the form of an aqueous solution having a strength of from 10 to 90, preferably from 40 to 80, percent by weight.

In the Examples which follow, parts and percentages are by weight.

EXAMPLE 1

Two pieces, each of 100 parts by weight, cut from adjacent parts of a hide, of conventionally chrome-tanned side leather of 1.5 mm shaved thickness were drummed with 2 parts of sodium formate and 0.5 part of sodium bicarbonate in kicker drums, filled with 100 parts of water, for 60 minutes at 30° C. After this treatment, the neutralizing liquor had a pH of 4.8. The leather was then rinsed with fresh water for 5 minutes. Thereafter, leather A was treated in a liquor of 150% length, at 50° C., with 2 parts of a 70 percent strength aqueous surfactant mixture and 1 part of the dye 4-chloroaniline→1,8,3,6-aminonaphtholdisulfonic acid←4,4'-diaminodiphenylamine-2-sulfonic acid→3-hydroxydiphenylamine. The surfactant mixture consisted of 30 parts of a tallow alcohol reacted with 80 moles of ethylene oxide, 40 parts of an oleylamine reacted with 12 moles of ethylene oxide, and 30 parts of water. 4 parts of a commercial fatliquor based on sperm oil were then added and the leather was again drummed for 60 minutes and acidified with 0.5 part of formic acid. After drumming for a further 20 minutes, the leather was taken out of the liquor and finished in the conventional manner.

Leather B was treated in the same way, but no surfactant mixture was added to the dye liquor.

After the leather samples had been dried, sawdusted and staked, they were assessed. The dye penetration in leather A was substantially better than in leather B.

EXAMPLE 2

Two pieces, each of 100 parts by weight, cut from adjacent parts of a hide, of conventionally chrome-tanned side leather of 1.5 mm shaved thickness were drummed with 0.2 part of acetic acid of 6° Bé strength and 0.3 part of tetrasodium ethylenediaminetetraacetate in kicker drums, filled with 200 parts of water, for 15 minutes at 40° C. The leather samples were then neutralized in 100 parts of water with 2 parts of sodium sulfite and 1 part of sodium formate by drumming for 60 minutes at 40° C. in a kicker drum (final pH: 4.9). The leather samples were then drummed in 30 parts of water with 6 parts of mimosa extract, 6 parts of sumach extract, 6 parts of a synthetic tanning agent based on phenolsulfonic acid, 1 part of sodium formate, 0.3 part of tetrasodium ethylenediaminetetraacetate and 3 parts of a commercial fatliquor based on sperm oil, for 90 minutes at 40° C. Thereafter, the retanned leather samples were washed for 10 minutes with 300 parts of water at 50° C. Finally, the leather samples were dyed in 100 parts of water, at 50° C., with 2 parts of the dye consisting of the 1:1 copper complex of

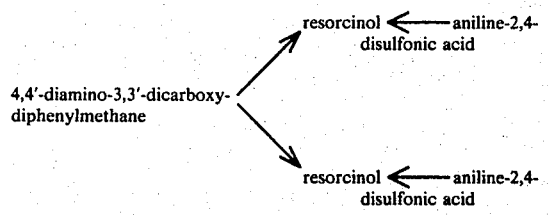

1 part of the surfactant mixture referred to in Example 1 was then added to the dye liquor for leather A, whilst the mixture was not added to the dye liquor for leather B.

The leather samples were then drummed for 15 minutes and afterwards fatted, and finished, as described in Example 1.

Leather A was dyed substantially more deeply than leather B; the levelness of the dyeing of leather A was also excellent.

In Examples 3 to 6 the procedure followed was as described in Example 1, whilst in Examples 7 to 9 it was as described in Example 2. The results were comparable. Details are to be found in the Table which follows.

| Example | Surfactant mixture a (alcohol) | Surfactant mixture b (amine) | Weight ratio a:b:water | Amount of surfactant a + b [parts] | Dye |
|---|---|---|---|---|---|
| 3 | natural tallow alcohol + 8 EO (8 moles of ethylene oxide) | oleylamine + 40 moles of EO | 4:1:3 | 2.5 | iron 1:2 complex of C.I. 34,905 |
| 4 | natural tallow alcohol + 8 EO | oleylamine + 120 EO | 3:1:4 | 3 | 1:2 chromium complex of 4-nitrophenol-6-sulfonic acid-(2 azo 4)- |

-continued

| Example | Surfactant mixture a (alcohol) | b (amine) | Weight ratio a:b:water | Amount of surfactant a + b [parts] | Dye |
|---|---|---|---|---|---|
| | (8 moles of ethylene oxide) | | | | 1-phenyl-3-methylpyrazol-5-one |
| 5 | $C_{13-15}$-oxo-alcohol + 12 EO | tridecyl-amine + 40 EO | 1:2:6 | 3 | 2-hydroxy-naphthalene-6-sulfonic acid-(1 azo 4)-2,2'-dimethyl-diphenylmethane-(4' azo 1)-2-hydroxy-naphthalene-6-sulfonic acid |
| 6 | synthetic tallow alcohol + 25 EO | 2-ethyl-hexylamine + 20 EO | 1:1:6 | 3 | 2-hydroxy-4-phenylaminobenzene-(1 azo 4)-diphenylaminosulfonic acid-3'-(4' azo 7)-1-amino-8-hydroxy-naphthalene-3,6-disulfonic acid |
| 7 | natural tallow alcohol + 80 EO | oleylamine + 80 EO | 3:1:4 | 1 | double copper complex of benzene-2,4-disulfonic acid-(1 azo 6)-1,3-dihydroxybenzene-(4 azo 4)-diphenylmethane-3,3'-dicarboxylic acid-(4' azo 6)-1,3-dihydroxybenzene-(4 azo 1)-benzene-2,4-disulfonic acid |
| 8 | $C_{9-11}$-oxo-alcohol + 3 EO | tridecyl-amine + 40 EO | 1:1:2 | 1 | 1-(2-methyl-phenyl-4-sulfonic acid)-3-methylpyrazol-5-one-(4 azo 4)-diphenylmethane-(4' azo 4)-1-(2-methyl-phenyl-4-sulfonic acid)-3-methyl-pyrazol-5-one |
| 9 | synthetic tallow alcohol + 18 EO | stearyl-amine + 60 EO | 1:4:8 | 0.4 | C.I. 16,055 |

We claim:

1. A process for dyeing grain leather with anionic dyes in the presence of surfactants by dyeing in a drum or dyeing apparatus for from 30 to 180 minutes at from 5° to 60° C. with a liquor length of from 50 to 500%, without subsequent moist storage, wherein the surfactant employed is a combination of (a) an aliphatic alcohol of 9 to 24 carbon atoms oxyethylated with from 3 to 120 ethylene oxide units and (b) an aliphatic primary or secondary amine of 8 to 20 carbon atoms per alkyl group oxylated with from 6 to 80 ethylene oxide units, in the weight ratio a:b from 1:4 to 4:1, and in a total amount of from 0.3 to 3%, based on the shaved weight.

2. A process for dyeing grain leather as claimed in claim 1, wherein cationically tanned leather is dyed which may, additionally to the cationic tanning agent, contain up to 6%, based on dry weight, of an anionic tanning agent, and the surfactant combination is employed 0 to 30 minutes before the leather is treated with the dye.

3. A process for dyeing grain leather as claimed in claim 1, wherein anionically tanned or retanned leather is dyed and the leather is treated with the surfactant combination from 5 to 90 minutes after being treated with the dye.

* * * * *